US008746349B2

(12) United States Patent
Larson et al.

(10) Patent No.: US 8,746,349 B2
(45) Date of Patent: Jun. 10, 2014

(54) DRILLING RISER ADAPTER CONNECTION WITH SUBSEA FUNCTIONALITY

(75) Inventors: Eric Dale Larson, Tomball, TX (US); Robert Allen Blue, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 305 days.

(21) Appl. No.: 13/038,044

(22) Filed: Mar. 1, 2011

(65) Prior Publication Data

US 2012/0222865 A1 Sep. 6, 2012

(51) Int. Cl.
*E21B 17/01* (2006.01)

(52) U.S. Cl.
USPC ..... 166/345; 166/350; 166/359; 166/338; 166/367

(58) Field of Classification Search
CPC ..... E21B 17/085; E21B 33/038
USPC ..... 166/338, 340, 341, 344, 345, 350, 367, 166/378, 381; 285/920, 322
See application file for complete search history.

(56) References Cited

U.S. PATENT DOCUMENTS

| | | | | |
|---|---|---|---|---|
| 4,097,069 | A * | 6/1978 | Morrill | 285/84 |
| 4,433,859 | A | 2/1984 | Driver et al. | |
| 4,688,633 | A * | 8/1987 | Barkley | 166/341 |
| 4,902,044 | A | 2/1990 | Williams et al. | |
| 5,433,274 | A | 7/1995 | Graff et al. | |
| 6,035,938 | A | 3/2000 | Watkins | |
| 6,129,149 | A | 10/2000 | Beall | |
| 6,328,343 | B1 | 12/2001 | Hosie et al. | |
| 6,330,918 | B1 * | 12/2001 | Hosie et al. | 166/341 |
| 6,793,019 | B2 * | 9/2004 | Rodgers et al. | 166/344 |
| 7,331,395 | B2 * | 2/2008 | Fraser et al. | 166/345 |
| 7,337,848 | B2 | 3/2008 | Fraser et al. | |
| 7,735,561 | B2 * | 6/2010 | Johnson et al. | 166/339 |
| 2006/0042791 | A1 * | 3/2006 | Hosie et al. | 166/100 |
| 2009/0308658 | A1 | 12/2009 | Larson et al. | |
| 2010/0025044 | A1 * | 2/2010 | McKay et al. | 166/359 |
| 2012/0048566 | A1 * | 3/2012 | Coppedge et al. | 166/340 |
| 2012/0145406 | A1 * | 6/2012 | Kotrla et al. | 166/344 |
| 2012/0168167 | A1 * | 7/2012 | Baugh | 166/338 |
| 2012/0318516 | A1 * | 12/2012 | Beynet et al. | 166/344 |
| 2013/0014954 | A1 * | 1/2013 | Killeen | 166/341 |

FOREIGN PATENT DOCUMENTS

| | | | |
|---|---|---|---|
| GB | 2414752 | A | 7/2006 |
| GB | 2443776 | | 5/2008 |
| WO | 2006/023690 | A2 | 3/2006 |
| WO | 2008/109280 | A1 | 9/2008 |

OTHER PUBLICATIONS

GB Search Report dated May 23, 2012 from corresponding Application No. GB1203404.7.

* cited by examiner

*Primary Examiner* — James Sayre
(74) *Attorney, Agent, or Firm* — Bracewell & Giuliani LLP

(57) ABSTRACT

A drilling riser adapter variably connects and releases a riser from a subsea wellhead assembly. The drilling riser adapter has a hydraulically actuated engagement assembly for selectively engaging and disengaging a lower end of the marine riser. The drilling riser adapter also includes a control panel communicatively coupled to the engagement assembly for actuating the engagement assembly to engage and disengage the lower end of the marine riser. The drilling riser adapter also includes a hydraulic fluid pressure receptacle on the control panel for engagement by a remotely operated vehicle to supply hydraulic fluid pressure to the engagement assembly. The drilling riser adapter may be actuated subsea to release a first riser from the wellhead assembly, and connect to a second riser.

10 Claims, 10 Drawing Sheets

DRILLING RISER ADAPTER CONNECTION WITH SUBSEA FUNCTIONALITY

BACKGROUND OF THE INVENTION

1. Field of the Invention

This invention relates in general to offshore well riser adapters and, in particular, to a system for connecting riser adapters to subsea equipment with subsea functionality.

2. Brief Description of Related Art

In offshore drilling operations, the operator will perform drilling operations through a drilling riser. The drilling riser extends between the subsea wellhead assembly at the seafloor and the drilling vessel. The drilling riser is made up of a number of individual joints or sections. These sections are secured to each other and run from a riser deploying floor of the drilling vessel. The drilling riser also normally has a number of auxiliary conduits that extend around the main central pipe. The auxiliary conduits supply hydraulic fluid pressure to the subsea blowout preventer and lower marine riser package.

The lower end of the drilling riser has an adapter that couples to a lower marine riser package (LMRP) for connecting the riser to the LMRP. Various adapters have been employed. The adapter connections include bolted flanges and locking segments radially moveable by screws. The LMRP attaches to a blowout preventer assembly (BOP). The BOP couples by a hydraulic connector to a subsea wellhead assembly at the sea floor. The LMRP also includes an emergency disconnect to quickly release from the BOP. The various hydraulically driven components of the LMRP are supplied with hydraulic fluid and controlled by lines leading to the surface vessel.

In both types of riser adapters, workers use wrenches to make up the bolts or screws. Making up the individual bolts is time consuming. Often when moving the drilling rig from one location to another, the riser has to be pulled and stored. In very deep water, pulling and rerunning the riser is very expensive. At least one automated system is shown in U.S. Pat. No. 6,330,918 for making up riser locking segment screws.

In addition, the automated and non-automated riser adapters fail to provide a way to break out the connection between the riser and the LMRP once the adapter and assembly are on the sea floor. Thus, where emergency events necessitate the ability to quickly disconnect an existing riser from the riser adapter while the LMRP remains on the sea floor, operators cannot quickly do so. This can potentially further exacerbate an already potentially dangerous situation. The emergency disconnect is controlled from the vessel, and the control line could be lost.

SUMMARY OF THE INVENTION

These and other problems are generally solved or circumvented, and technical advantages are generally achieved, by preferred embodiments of the present invention that provide a drilling riser adapter with subsea functionality, and a method for using the same.

An embodiment of the present invention provides a system for connecting a lower marine riser package (LMRP) to a marine riser. The LMRP and BOP will be placed subsea at a wellhead so that the riser will extend from the wellhead to a drilling rig located at a sea surface. The system comprises a drilling riser adapter, and a control panel. The drilling riser adapter has a hydraulically actuated engagement assembly. The engagement assembly selectively engages and disengages a lower end of the marine riser. The control panel communicatively couples to the engagement assembly and actuates the engagement assembly to engage and disengage the lower end of the marine riser. The control panel also has a hydraulic fluid pressure receptacle for engagement by a remotely operated vehicle for use subsea.

Another embodiment of the present invention provides a system for connecting a lower marine riser package (LMRP) to a marine riser. Again, the LMRP and BOP will be placed subsea at a wellhead so that the riser extends from the wellhead to a drilling rig located at a sea surface. The system comprises a plurality of engaging members, an engagement assembly, and a control panel. These engaging members are moveable between an engaged position radially inward and a disengaged position radially outward. The engagement assembly is configured to actuate the engaging members between the engaged and the disengaged positions. A crossover riser joint inserts into the drilling riser adapter and has an upper end that couples to the riser. The crossover riser joint has a lower end profile for mating with the engagement assembly when the engagement assembly is in the engaged position. The control panel communicatively couples to the engagement assembly and actuates the engagement assembly to engage to and disengage the lower end of the marine riser. The control panel includes a hydraulic fluid pressure receptacle for engagement by a remotely operated vehicle (ROV) to supply hydraulic fluid pressure to the engagement assembly.

Yet another disclosed embodiment provides a method for disconnecting a lower marine riser joint from a lower marine riser package. The method begins by providing a marine riser adapter having a hydraulically actuated engagement assembly and a control panel with a hydraulic fluid pressure receptacle. Next, the method connects the adapter to the LMRP. An end of a riser joint is then inserted into a central bore of the marine riser adapter. Next, the method supplies hydraulic fluid to actuate the engagement assembly into engagement with the riser joint. The LMRP, marine riser adapter, and riser joint are then lowered to a subsea location. An ROV then stabs a probe into the hydraulic fluid pressure receptacle and supplies hydraulic fluid to actuate the engagement assembly to disengage the riser from the marine riser adapter.

In still another embodiment, a system is provided for connecting a lower marine riser package to a drilling rig located at a sea surface. The lower marine riser package (LMRP) is to be placed subsea at a wellhead. The system comprises a plurality of marine riser joints for extending between the drilling rig and the LMRP, each marine riser joint having at least one end coupleable to an adjacent marine riser joint. The system also includes a drilling riser adapter for mounting to the lower marine riser package. The drilling riser adapter has a hydraulically actuated engagement assembly for selectively engaging and disengaging a lower end of at least one marine riser joint of the plurality of marine riser joints. A control panel is mounted to the adapter and communicatively coupled to the engagement assembly. The control panel actuates the engagement assembly to engage and disengage the lower end of the marine riser. A receptacle for receiving hydraulic fluid pressure is mounted on the control panel for engagement by a remote operated vehicle (ROV). The ROV will supply hydraulic fluid pressure to the engagement assembly.

Another embodiment provides a system for connecting a lower marine riser package to a marine riser. Again, the lower marine riser package (LMRP) is to be placed subsea at a wellhead so that the riser will extend from the LMRP to a drilling rig located at a sea surface. The system comprises a blowout preventer (BOP) mounted at an upper end of the LMRP, and a drilling riser adapter mounted to the BOP. The drilling riser adapter has a hydraulically actuated engagement assembly for selectively engaging and disengaging a lower end of the marine riser, and a control panel mounted to the adapter. The control panel is communicatively coupled to the engagement assembly for actuating the engagement assembly to engage and disengage the lower end of the marine riser. The control panel includes a receptacle for receiving hydraulic fluid pressure on so that a remote operated vehicle (ROV) may engage the control panel to supply hydraulic fluid pressure to the engagement assembly.

Still another embodiment provides a method for connecting a marine riser joint to a marine riser adapter located at a subsea location. The method comprises first stabbing a probe of a remotely operated vehicle (ROV) into a hydraulic fluid pressure receptacle of a marine riser adapter having a hydraulically actuated engagement assembly and a control panel with a hydraulic fluid pressure receptacle. Next, the method supplies hydraulic fluid from the probe of the ROV to the hydraulic fluid pressure receptacle to actuate the engagement assembly to disengage a first riser joint from the riser adapter. Then, the first riser joint is removed from the riser adapter, and a second riser joint is disposed into the riser adapter. The method continues by stabbing the probe of the ROV into the hydraulic fluid pressure receptacle of the marine riser adapter, and then supplying hydraulic fluid from the probe of the ROV to the hydraulic fluid pressure receptacle to actuate the engagement assembly to engage the second riser joint with the riser adapter.

An advantage of the disclosed embodiments is that the disclosed drilling riser adapter reduces the time necessary to make up the connection between the LMRP/BOP assembly and the riser at the surface. In addition, the disclosed drilling riser adapter requires fewer workers to make up the connection. Embodiments of the present invention are suitable for use with any riser connection type with the addition of a crossover joint between the drilling riser adapter and the riser. Furthermore, the disclosed embodiments provide a drilling riser adapter that allows for connection and disconnection of the riser from the LMRP/BOP assembly in a subsea environment through the use of remotely operated vehicles. This can be accomplished in significantly less time and effort over prior art methods for making up and breaking out a riser from a wellhead assembly in a subsea environment.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of the invention's scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling operations, rig operations, general riser make up and break out, and the like have been omitted inasmuch as such details are not considered necessary to obtain a complete understanding of the present invention, and are considered to be within the skills of persons skilled in the relevant art.

Figure 1:
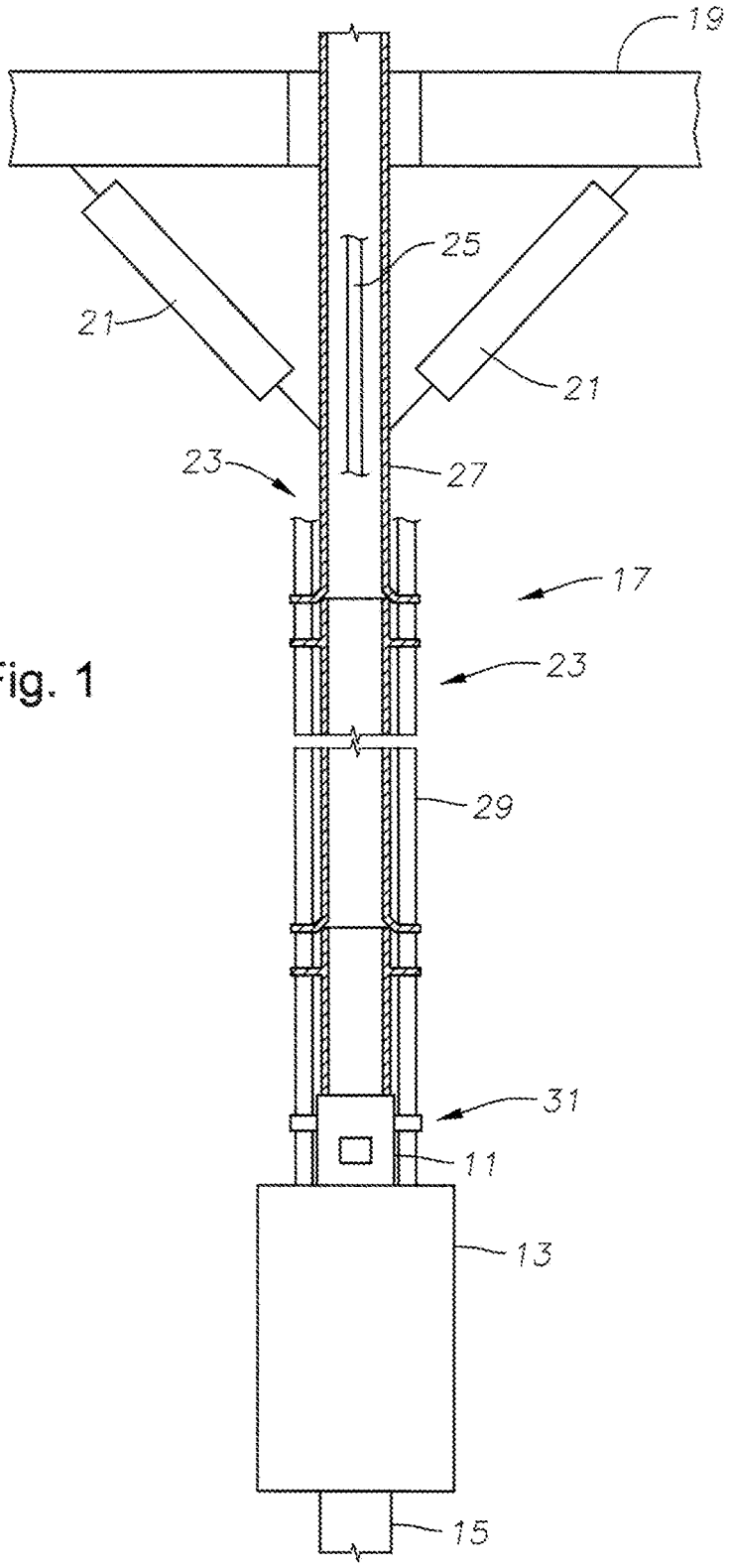
FIG. 1 is a schematic representation of a drilling riser adapter in use in a subsea assembly.

Referring to FIG. 1, there is shown a drilling riser adapter 11 configured to connect a marine riser string 17 to a lower marine riser package and blowout preventer (BOP) 13, which is, in turn secured to a subsea wellhead or subsea tree 15 of the well. Marine riser string 17 extends upward from the drilling riser adapter 11 to a floating platform 19 and is supported in tension from floating platform 19 by riser tensioners 21. Marine riser string 17 is comprised of a series of riser joints 23 that extend from floating platform 19 to lower marine riser package 13. Marine riser string 17 enables drill pipe 25 to be deployed from floating platform 19 to lower marine riser package 13 and on through wellhead 15 into the seabed through a central tube 27. Auxiliary tubes 29 located around the central pipe of marine riser string 17 may be used for purposes such as serving as choke-and-kill lines for recirculating drilling mud below a blowout preventer (BOP) in the event that the BOP prevents flow through central tube 27. A cross over joint 31 enables marine riser string 17 to connect to drilling riser adapter 11. Crossover joint 31 has a profile on an exterior diameter surface of a lower end of crossover joint 31. The profile is configured to engage drilling riser adapter 11. An upper end of cross over joint 31 is configured to engage the coupling type used by riser joints 23. A person skilled in the art will understand that the upper end of crossover joint 31 may be any suitable joint configuration such that crossover joint 31 connects to marine riser string 17. Similarly, a person skilled in the art will recognize that alternative embodiments do not include crossover joint 31.

Figure 2:
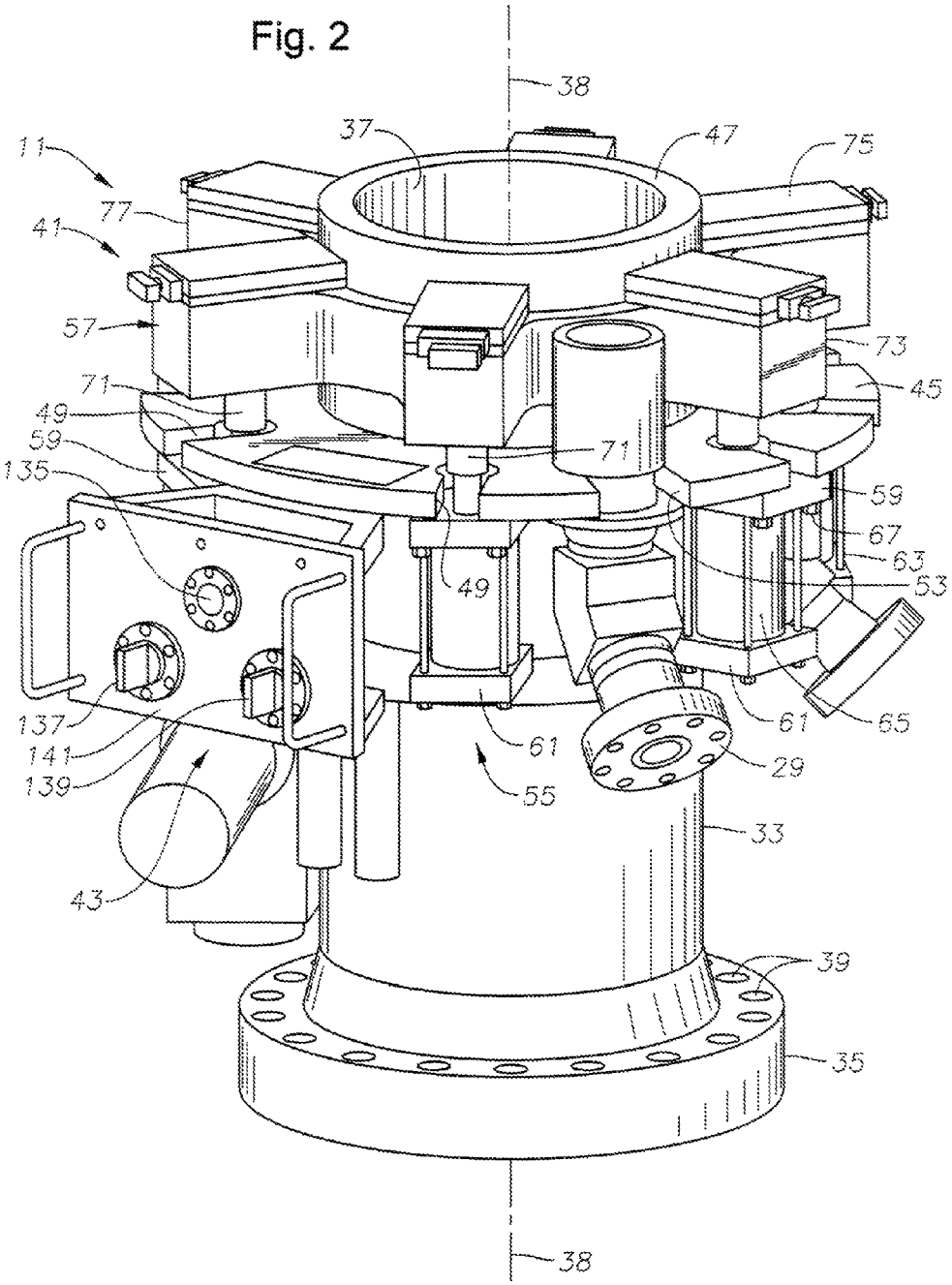
FIG. 2 illustrates a perspective view of the drilling riser adapter of FIG. 1 in accordance with an embodiment of the present invention.

Referring now to FIG. 2, drilling riser adapter 11 may be a tubular member 33 having a flanged lower end 35. Tubular member 33 may taper from an exterior diameter of tubular member 33 to a slightly larger diameter adjacent to flanged lower end 35. Tubular member 33 defines a central bore 37 having an axis 38, and an inner diameter slightly larger than the outer diameter of crossover joint 31 (FIG. 1), thereby enabling a lower end of crossover joint 31 to insert into central bore 37. Tubular member 33 also defines a shoulder 32 (FIG. 6) within central bore 37 proximate to an opening 127, such that a profile 133 of crossover joint 31 may mate with an engaging member 125 as described in more detail below with respect to FIG. 6. As shown in FIG. 2, flanged lower end 35 defines a plurality of holes 39. Holes 39 align with corresponding holes in an upper portion of lower marine riser package 13 (FIG. 1) and are configured to receive bolts (not shown) that will secure drilling riser adapter 11 to lower marine riser package 13. The bolting attachment mechanism between drilling riser adapter 11 and lower marine riser package 13 is shown for reference. A person skilled in the art will understand that other attachment mechanisms, such as welding, clamping, etc., are contemplated and included in the disclosed embodiments.

Figure 3:
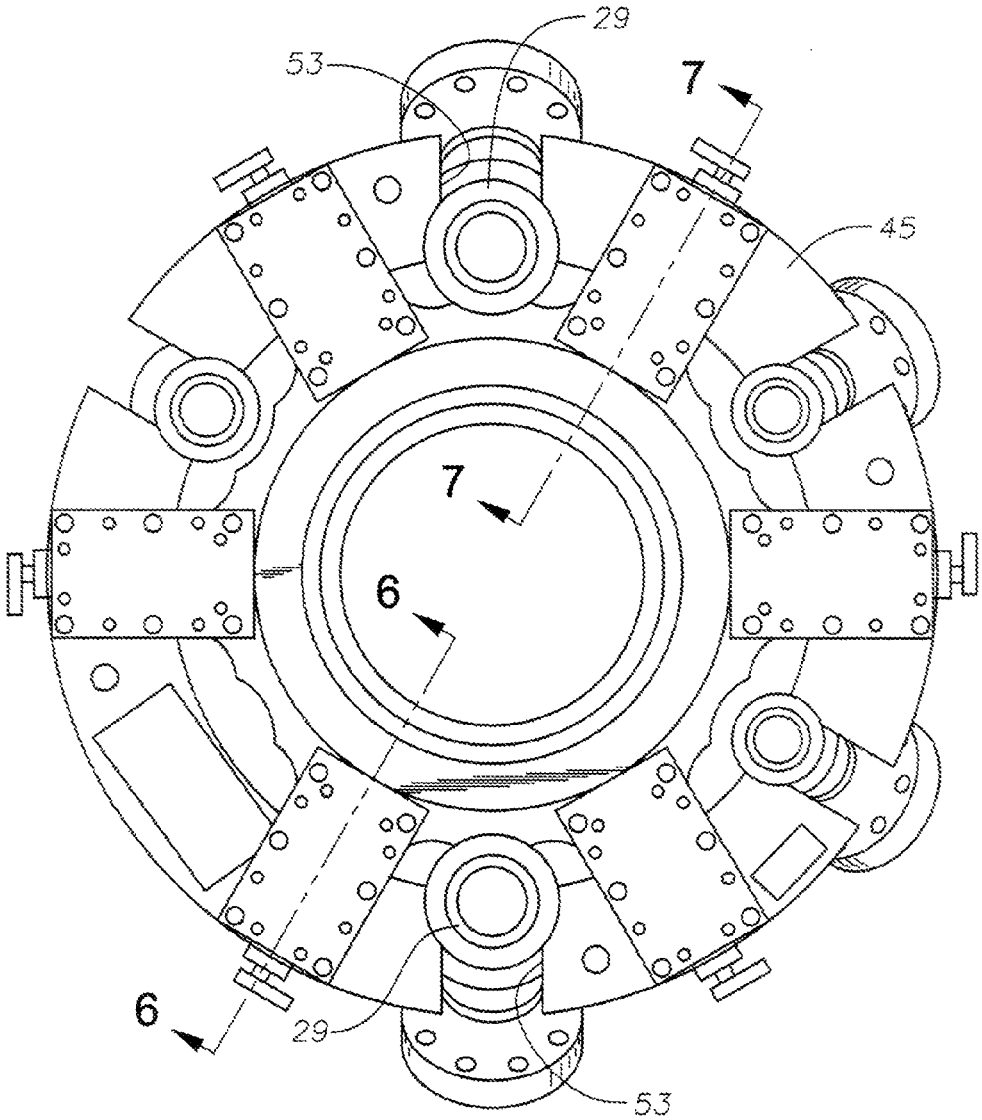
FIG. 3 is a top view of the drilling riser adapter of FIG. 2.

Drilling riser adapter 11 also includes an engagement assembly 41, a remote operation assembly 43, and an upper flange 45. Upper flange 45 extends from an exterior portion of drilling riser adapter 11 proximate to, but axially lower than, an upper rim 47 of drilling riser adapter 11. Upper flange 45 defines a plurality of slotted openings 49 extending from a rim of upper flange 45 inward toward tubular member 33. Slotted openings 49 are of a size and shape to accommodate cylinder rods, described in more detail below. Upper flange 45 also defines slotted auxiliary openings 53 extending from a rim of upper flange 45 inward toward tubular member 33. Auxiliary openings 53 are generally larger than slotted openings 49 and are of a size and shape needed to accommodate auxiliary tubes 29. As shown on FIG. 3, upper flange 45 includes two auxiliary openings 53. A person skilled in the art will understand that more or fewer auxiliary openings 53 are contemplated and included in the disclosed embodiments. In addition, drilling riser adapter 11 may include additional openings extending from the rim of upper flange 45 toward tubular member 33 to accommodate other lines, or devices secured to marine riser string 17.

Referring to FIG. 2, engagement assembly 41 includes cylinder assemblies 55, and a cam ring assembly 57. Cylinder assemblies 55 couple to upper flange 45 and extend from a lower surface of upper flange 45 toward lower flange 35. In the illustrated embodiment, six cylinder assemblies 55 are included. A person skilled in the art will understand that more or fewer cylinder assemblies 55 may be included in drilling riser adapter 11. Cylinder assemblies 55 are spaced circumferentially around upper flange 45 such that each cylinder assembly 55 is equidistant from the two adjacent cylinder assemblies 55. Each cylinder assembly 55 includes upper and lower support plates 59, 61, support rods 63, and a cylinder 65. A base 69 of each cylinder 65 is supported by a respective lower support plate 61. In the illustrated embodiment, cylinders 65 are positioned so that the extension stroke of each cylinder will extend toward rim 47 of tubular member 33, and the retraction stroke of each cylinder will contract into base 69 toward flange 35.

In the exemplary embodiment, each lower support plate 61 couples to a respective upper support plate 59 with four support rods 63. A person skilled in the art will understand that more or fewer support rods 63, or any other suitable coupling system providing support for base 69 of cylinder 65 is contemplated and included in the disclosed embodiments. Support rods 63 have a lower threaded end that passes through bores in lower support plate 61 and are secured by nuts having a sufficient strength rating to provide a react force to force exerted against lower support plate 61 by cylinder 65. Similarly, support rods 63 have an upper threaded end that passes through bores in the upper support plate 59 and are secured by nuts (not shown) having a sufficient strength rating to provide a react force to force exerted against upper support plate 59 by cylinder 65. Upper support plate 59 in turn couples to the lower surface of upper flange 45. In the illustrated embodiment, bores in upper support plate 59 align with threaded bores (not shown) extending inward from the lower surface of upper flange 45. Bolts 67 pass through the bores in upper support plate 59 and screw into the corresponding threaded bores in the lower surface of upper flange 45.

Figure 5:
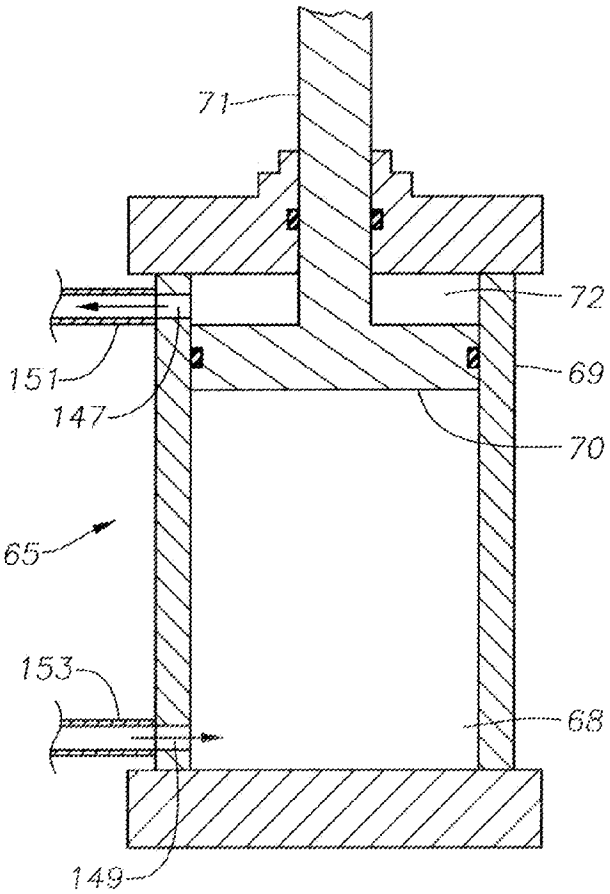
FIG. 5 is a schematic sectional view of the double acting hydraulic cylinder of FIG. 2 in a second position.
Figure 4:
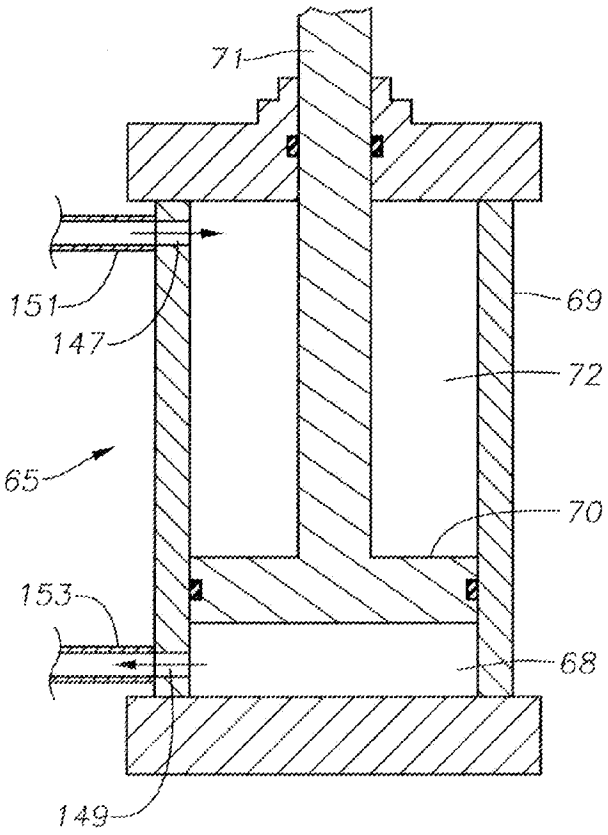
FIG. 4 is a schematic sectional view of a double acting hydraulic cylinder of FIG. 2 in a first position.

Referring to FIGS. 4 and 5, cylinders 65 are double acting hydraulic cylinders that include a base 69, a rod 71, and a piston head 70. Base 69 defines a chamber having an opening at an upper end for passage of rod 71 from an interior of the chamber of base 69 to an exterior of the chamber of base 69. Base 69 is sealed at the location where rod 71 passes from the interior to the exterior of the chamber by any suitable sealing method such as elastomer o-rings or the like. Piston head 70 couples to an end of rod 71 and comprises a geometric shape configured to substantially fill a width of the chamber of base 69 and divide it into a lower chamber 68 and an upper chamber 72. A hydraulic fluid may variably flow into and out of upper and lower chambers 72, 68 through an engaging circuit 151 and upper port 147 or alternatively through a disengaging circuit 153 and lower port 149. As illustrated in FIG. 4, fluid will flow into chamber 68 through port 149 and, as chamber 68 fills, exert a force on a face of piston head 70 that pushes piston head 70, and rod 71, up out of base 69. In response, hydraulic fluid in chamber 72 will flow out port 147 until piston head 70 occupies the position shown in FIG. 5.

In a similar operation, fluid will flow into chamber 72 through port 147 and, as chamber 72 fills, exert a force on piston head 70. In response, hydraulic fluid in chamber 68 will flow out port 149 until piston head 70 occupies the position shown in FIG. 4. Piston head 70 seals to the interior surface of the chamber of base 69 with any suitable sealing method such that piston head 70 may traverse between a lower position, shown in FIG. 4, to an upper position, shown in FIG. 5. In this manner, cylinder 65 will actuate to move rod 71 axially up and down. Actuation of cylinders 65, in turn causes actuation of cam ring assembly 57, described in more detail below.

Referring to FIG. 2, the upper ends of rods 71 extend through slotted openings 49 and engage cam ring assembly 57. Cam ring assembly 57 includes cam ring 73 and secondary engaging assemblies 75. Cam ring 73 has an inner diameter slightly larger than the outer diameter of tubular member 33 such that an inner diameter of cam ring 73 may slidingly engage the exterior surface of tubular member 33. Cam ring 73 includes cylinder coupler protrusions 77 extending radially from an exterior diameter portion of cam ring 73 proximate to and axially over cylinders 65. In the illustrated embodiment, each cylinder coupler protrusion 77 corresponds and is axially above a respective cylinder assembly 55, such that the number of cylinder coupler protrusions 77 corresponds to the number of cylinder assemblies 55. As shown, cylinder coupler protrusions 77 are box like protrusions of a sufficient strength to transfer axial force exerted by cylinder assemblies 55 on cylinder coupler protrusions 77 to cam ring 73. A person skilled in the art will understand that other shapes for cylinder coupler protrusions 77 are contemplated and included in the disclosed embodiments. Furthermore, a person skilled in the art will also understand that cylinder assemblies 55 and cam ring assembly 57 may be oriented in relation to one another so that cam ring assembly 57 is axially beneath cylinder assemblies 55.

Figure 6:
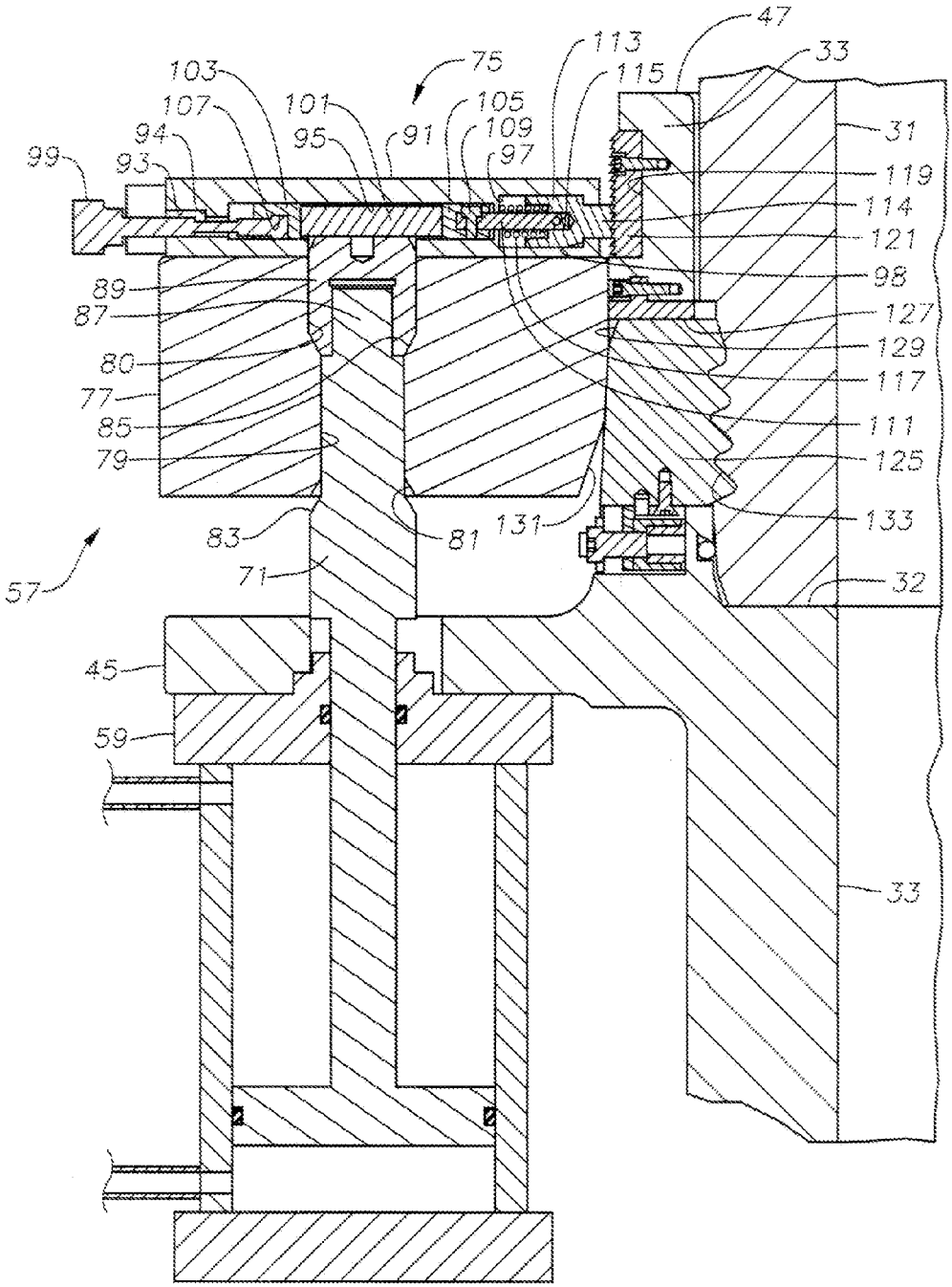
FIG. 6 is a partial sectional view of the drilling riser adapter in an engaged position, taken along line 6-6 of FIG. 3.

Referring to FIG. 6, there is shown a partial cross section of drilling riser adapter 11 illustrating additional components of cam ring assembly 57. In the exemplary embodiment, each cylinder coupler protrusion 77 defines a bore 79 extending from a lower surface of cylinder coupler protrusion 77 proximate to rod 71 to an upper surface of cylinder coupler protrusion 77. Bore 79 has a lower bevel 81 transitioning from bore 79 to the lower surface of cylinder coupler protrusion 77. Bevel 81 has a wider diameter at the lower surface of cylinder coupler protrusion 77 and a narrower diameter at bore 79. Bore 79 also includes an upper bevel 85 transitioning from bore 79 to a counterbore 80 at an upper surface of cylinder coupler protrusion 77.

Similarly, rod 71 includes a beveled surface 83 transitioning rod 71 from a wider diameter on a lower end of rod 71 to a narrower diameter approximately equivalent to the diameter of bore 79. The narrower diameter end of rod 71 inserts into bore 79. Rod 71 has an adapter portion 87 formed in an upper end of rod 71 that has a diameter smaller than the diameter of bore 79. A rod locker 89 inserts into counterbore 80 from the upper surface of cylinder coupler protrusion 77. Rod locker 89 has a diameter substantially equivalent to the diameter of counterbore 80 near the upper surface of cylinder coupler protrusion 77 and a beveled edge at a lower end of rod locker 89 that abuts bevel 85 of bore 79. Rod locker 89 secures to the adapter portion 87 of rod 71, thereby securing rod 71 to cylinder coupler protrusion 77. A person skilled in the art will understand that any suitable method to secure adapter portion 87 to rod locker 89 is contemplated and included in the disclosed embodiments. For example, the exterior diameter Surface of adapter portion 87 may be threaded, and the inner diameter surface of rod locker 89 may have a matching thread that allows rod locker 89 to screw onto adapter portion 87. In this manner, motion of rod 71 may transmit into motion of cylinder coupler protrusion 77 and cam ring 73 as described in more detail below.

Drilling riser adapter 11 may include a secondary engagement assembly 75 as described below. A person skilled in the art will understand that alternative embodiments of drilling riser adapter 11 may include secondary engaging assemblies other than those illustrated herein, or no secondary engagement assembly at all. Still referring to FIG. 6, secondary engagement assembly 75 includes a base member 91 that couples to the upper surface of cylinder coupler protrusion 77. In the illustrated embodiment of FIG. 7, base member 91 defines three chambers, a first chamber 93 proximate to an exterior or radially outer end of base member 91 opposite tubular member 33, a second chamber 95 near a center of base member 91, and a third chamber 97 proximate to the exterior diameter of tubular member 33. Each chamber has an opening to the adjacent chamber allowing mechanical communication between the chambers. In addition, chamber 93 has an opening at the exterior end of base member 91 for mechanical communication with an object outside of chamber 93. Similarly, chamber 97 includes an opening at the interior end of base member 91 proximate to tubular member 33 for mechanical communication between an object in chamber 97 and tubular member 33.

A latch 99, comprising a substantially cylindrical member having a handle at a first end, inserts into chamber 93 from an exterior of base member 91. The handled end of latch 99 remains outside of base member 91 and chamber 93. A second end of latch 99 passes through chamber 93 and into chamber 95. A transmission rod 101 having bushing ends 103, 105 resides in chamber 95. Transmission rod 101 substantially fills the height of chamber 95. Transmission rod 101 has a length less than the length of chamber 95, allowing transmission rod to move radially within chamber 95. A bushing end 103 has an internal profile 107. The second end of latch 99 comprises a matching profile to internal profile 107. The second end of latch 99 inserts into bushing end 103 and mates with internal profile 107 such that lateral movement of latch 99 will cause transmission rod 101 to move radially in response. A bushing end 105 defines a threaded opening for a bolt or set screw 109. A spring pin 111 inserts into bushing end 105 and is secured to bushing end 105 by set screw 109. Spring pin 111 moves radially in response to lateral movement by transmission rod 101. Spring pin 111 passes from chamber 95 into chamber 97.

A latch dog 113 having an engaged and a disengaged position, resides within chamber 97. Latch dog 113 has an engaging end 114 having a height less than the height of latch dog 113. Engaging end 114 passes through an opening in chamber 97 to an exterior of base member 91 proximate to tubular member 33. The opening has a height substantially equal to engaging end 114 but less than the height of chamber 97 such that the opening defines a shoulder 98. In this manner, engaging end 114 may protrude from chamber 97, while latch dog 113 is prevented from completely exiting chamber 97 by shoulder 98. Latch dog 113 includes a recess 115 on an end opposite engaging end 114 protruding from chamber 97. Spring pin 111 inserts into recess 115 and is secured by a pin passing through a bore of spring pin 111 and latch dog 113. Recess 115 has a counterbore defining a spring seat. A spring 117 surrounds spring pin 111 and is interposed between a sidewall of chamber 97 proximate to chamber 95 and the spring seat of recess 115. In the illustrated embodiment, spring 117 biases latch dog 113 to the engaged position.

Figure 7:
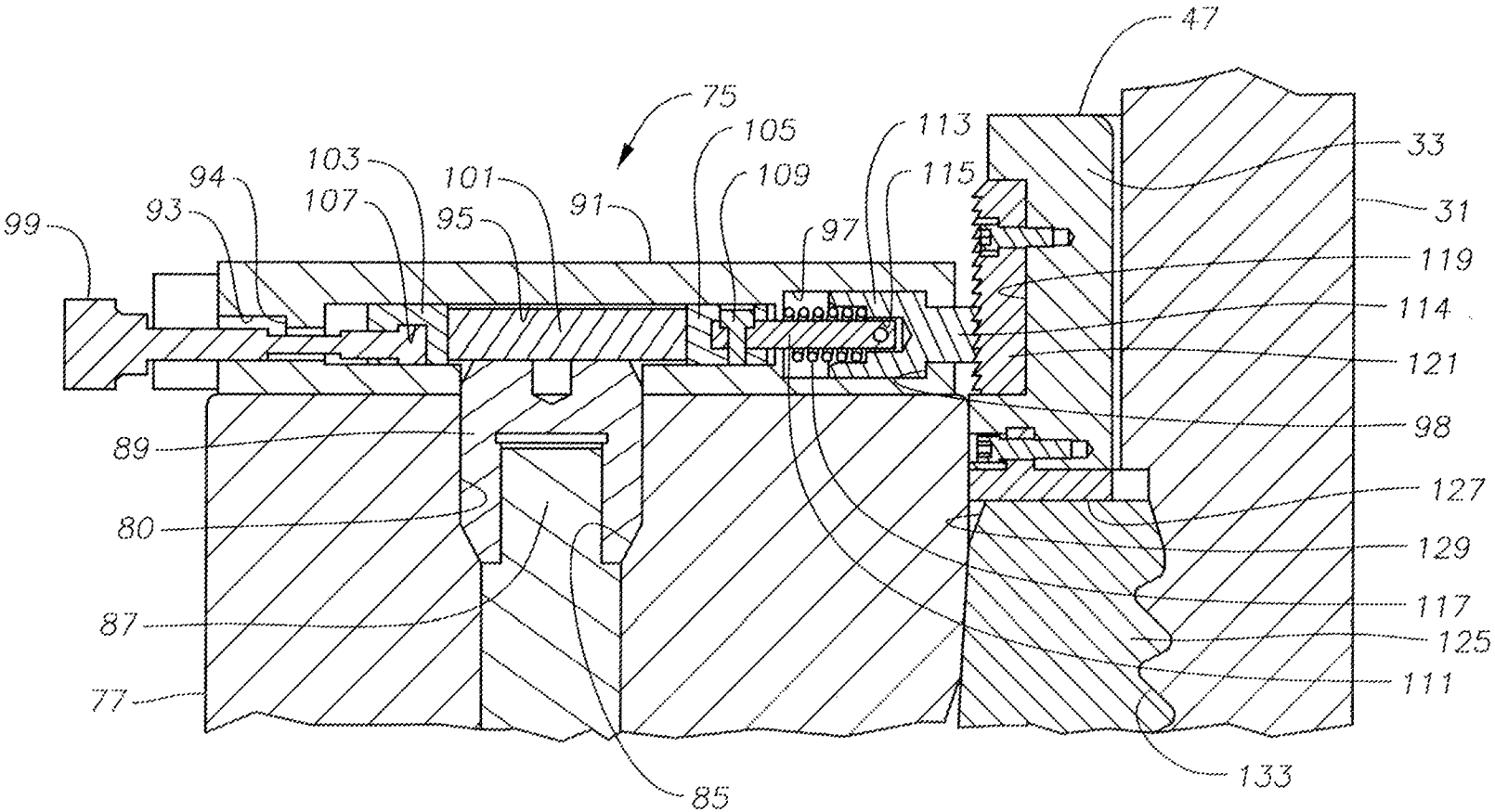
FIG. 7 is a partial sectional view of a secondary engagement assembly of FIG. 6 in an engaged position.

Still referring to FIG. 7, an upper end of tubular member 33 defines a secondary engaging recess 119 proximate to upper rim 47. In the exemplary embodiment, secondary engaging recess 119 is substantially rectangular and extends from an exterior surface of tubular member 33 inward toward bore 37. A secondary engaging member 121 couples to tubular member 33 in secondary engaging recess 119, such as with the illustrated bolts. Secondary engaging member 121 substantially fills secondary engaging recess 119. Secondary engaging member 121 has an exterior profile configured to mate with engaging end 114 of latch dog 113 and prevent latch dog 113 from moving upward axially toward upper rim 47 when latch dog 113 engages secondary engaging member 121. The profile may comprise parallel, saw tooth shaped grooves. In this manner, latch dog 113 engages tubular member 33 in the engaged position, providing secondary engagement of cam ring 73 to tubular member 33.

Figure 8:
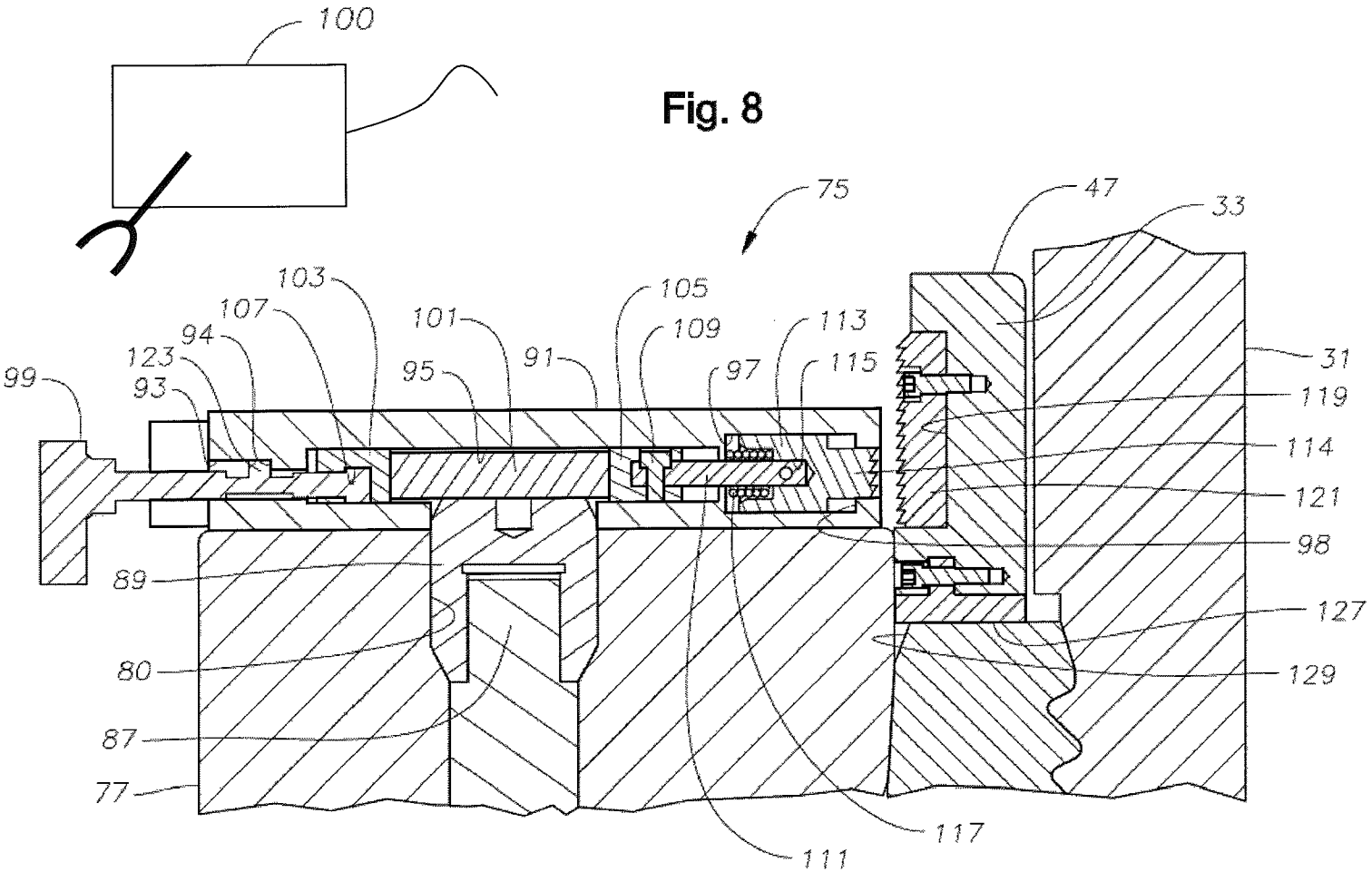
FIG. 8 is a partial sectional view of the secondary engagement assembly of FIG. 6 in a disengaged position.
Figure 10:
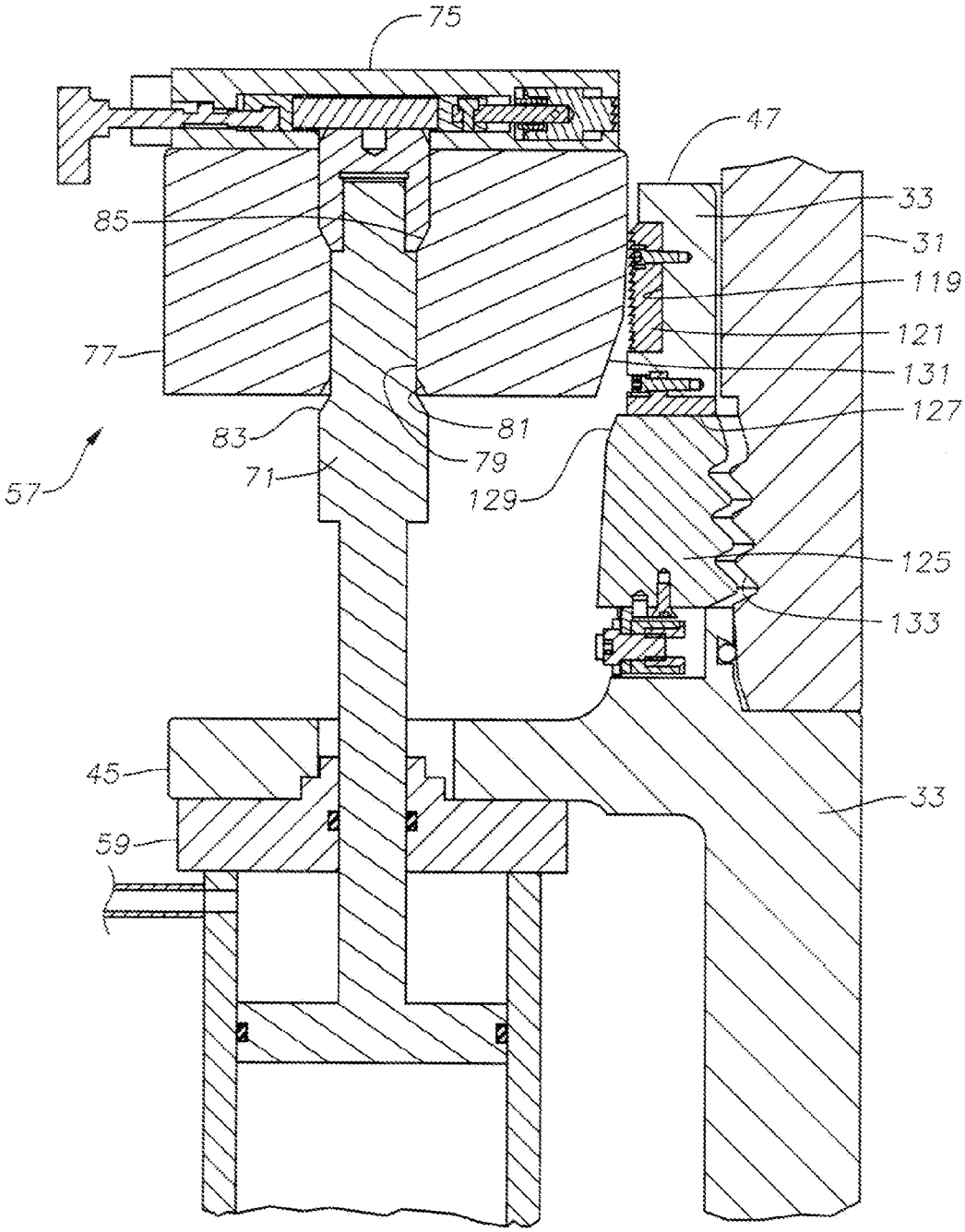
FIG. 10 is a partial sectional view of the drilling riser assembly in a disengaged position taken along line 6-6 of FIG. 3.

Secondary engagement assembly 75 has a locked or engaged position (FIG. 7) and a disengaged position (FIG. 8) and operates in the following manner. Latch 99 may be pulled radially away from tubular member 33 by an operator or a remotely operated vehicle (ROV) 100. Transmission rod 101 moves radially in response to the position shown in FIG. 8. Similarly, spring pin 111 pulls latch dog 113 radially away from secondary engaging member 121 in response. In the exemplary embodiment, latch 99 is then rotated 90 degrees, by an operator or ROV 100, to engage a key 123, machined into latch 99, with a shoulder 94, defined by a wall separating chamber 93 from chamber 95. While in the engaged position of FIG. 7, key 123 resides within the passageway between chamber 93 and chamber 95. Key 123 extends from latch 99 to a height greater than the width of latch 99, thus, when latch 99 is pulled radially and turned 90 degrees as shown in FIG. 8, a sidewall of key 123 will abut shoulder 94 of the passageway between chamber 93 and chamber 95. In this manner, latch 99 prevents spring 117 from returning latch dog 113 to the biased engaged/engaged position of FIG. 7. Prior to stabbing a riser end into bore 37 (FIG. 6), latch dogs 113 will be in the disengaged position as shown in FIG. 10. Operation of drilling riser adapter 11 will be described in more detail below.

Cam ring assembly 57 has an engaged position illustrated in FIG. 6, and a disengaged position, illustrated in FIG. 10. Referring to FIG. 10, rod 71 of cylinder 65 has actuated to raise cylinder coupler protrusion 77 of cam ring 73 to the disengaged position. In the disengaged position, a lower surface of cylinder coupler protrusion 77, and consequently cam ring 73, is axially above an upper surface of a cam dog 125. Cam dog 125 resides in an opening 127 in tubular member 33 proximate to and axially beneath secondary engaging recess 119 and secondary engaging member 121. Opening 127 extends from the exterior surface of tubular member 33 through the sidewall of tubular member 33 into bore 37. An opening 127 is located in tubular member 33 proximate to each cylinder coupler protrusion 77. A respective cam dog 125 substantially fills each respective opening 127 and has a bevel 129 on an upper outer exterior edge. Bevel 129 is configured to abut a corresponding bevel 131 of cylinder coupler protrusion 77 when cylinder coupler protrusion 77 moves from the disengaged position of FIG. 10 to the engaged position of FIGS. 6 and 9. The portion of each cam dog 133 below bevel 129 tapers outward.

In operation, cylinders 65 will actuate and pull rod 71 down into base member 69 (FIG. 1 and FIG. 4). In response, rods 71 will pull cylinder coupler protrusion 77 and cam ring 73 axially down. Bevel 131 of cylinder coupler protrusion 77 will contact bevel 129 of cam dog 125. As rod 71 continues to pull cylinder coupler protrusion 77 axially down, bevel 129 will slide along bevel 131, thereby exerting a force that moves cam dog 125 radially inward into engagement with a grooved surface profile 133 of crossover joint 31 as shown in FIG. 6. In this manner drilling riser adapter 11 will engage crossover joint 31, securing it to lower marine riser package 13 of FIG. 1. Each cam dog 125 has a grooved profile on its inner side that engages surface profile 133.

Referring now to FIG. 2, actuation of cylinders 65 of cylinder assemblies 55 may be controlled by remote operation assembly 43. Remote operation assembly 43 includes a control panel 141, a hot stab port 135, an engagement valve switch 137, and a disengagement valve switch 139. In the exemplary embodiment, control panel 141 couples to tubular member 33 at upper flange 45. Hot stab port 135, engagement switch 137, and disengagement switch 139 couple to control panel 141 facing away from tubular member 33 such that a remotely operated vehicle (ROY) may insert a hot stab into hot stab port 135 to supply hydraulic fluid pressure and manipulate switches 137, 139 to control cylinder assemblies 55. In the exemplary embodiment, hot stab port 135 may comprise a hot stab receptacle or a hydraulic fluid pressure receptacle configured to receive hydraulic fluid pressure from an external source into the hydraulic systems of drilling riser adapter 11. Similarly, the hot stab is a mechanism for supplying the external hydraulic fluid pressure to the drilling riser adapter 11 system.

Figure 11:
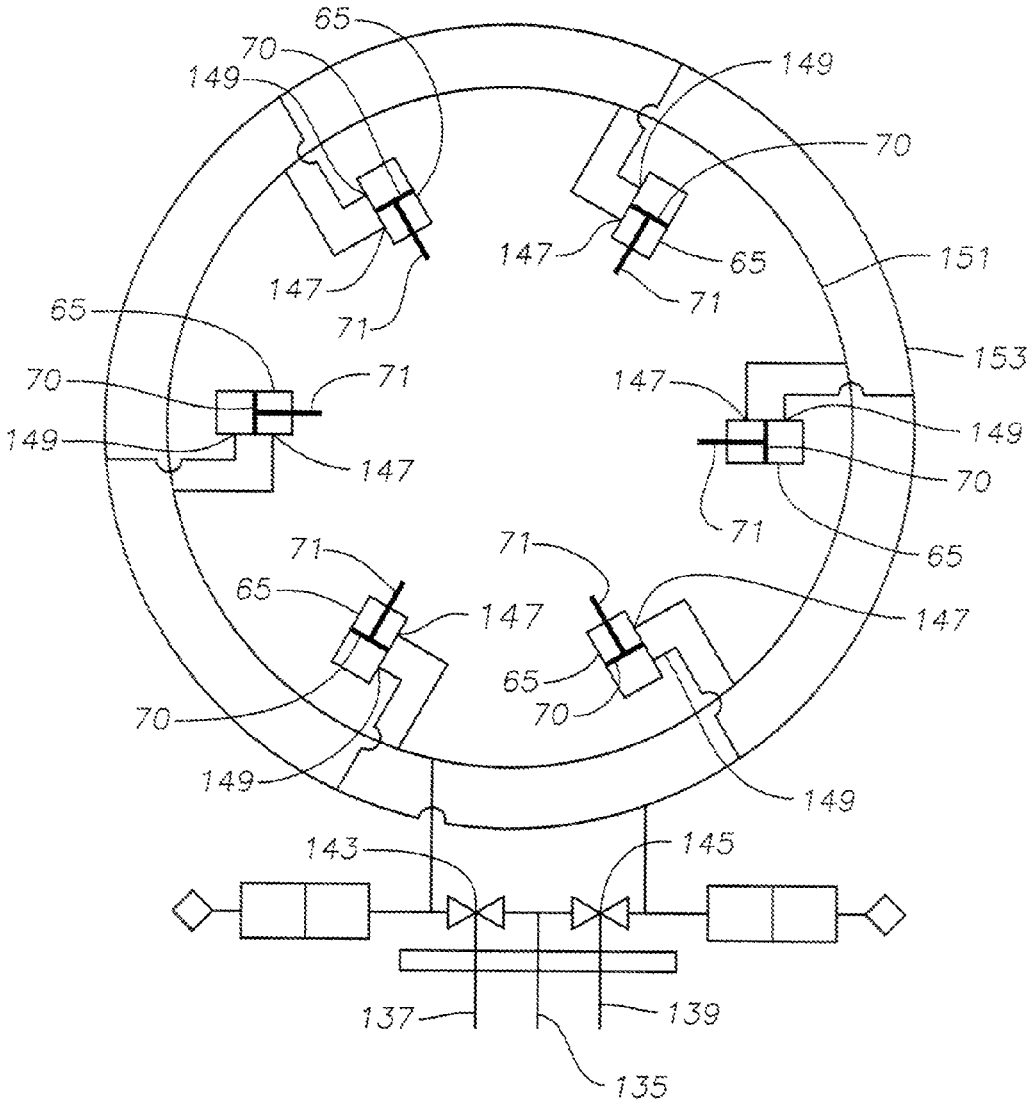
FIG. 11 is a schematic representation of a hydraulic actuation system of the drilling riser adapter of FIG. 2.

Switches 137, 139 connect to control stems of valves 143, 145 (FIG. 11) respectively. Manipulation of switches 137, 139 will manipulate flow through valves 143, 145 in response. In the illustrated embodiment, hot stab port 135, and valves 143, 145, are communicatively coupled through hydraulic lines (schematically shown in FIG. 11) to upper and lower ports 147, 149 of cylinders 65. Fluid passing through the hydraulic lines will flow through upper and lower ports 147, 149 actuating cylinders 65 by exerting a force on a piston head 70 coupled to rod 71. An engaging hydraulic circuit 151 communicatively couples ports 147, valve 143, and switch 137. A disengaging hydraulic circuit 153 communicatively couples ports 149, valve 145, and switch 139.

Figure 9:
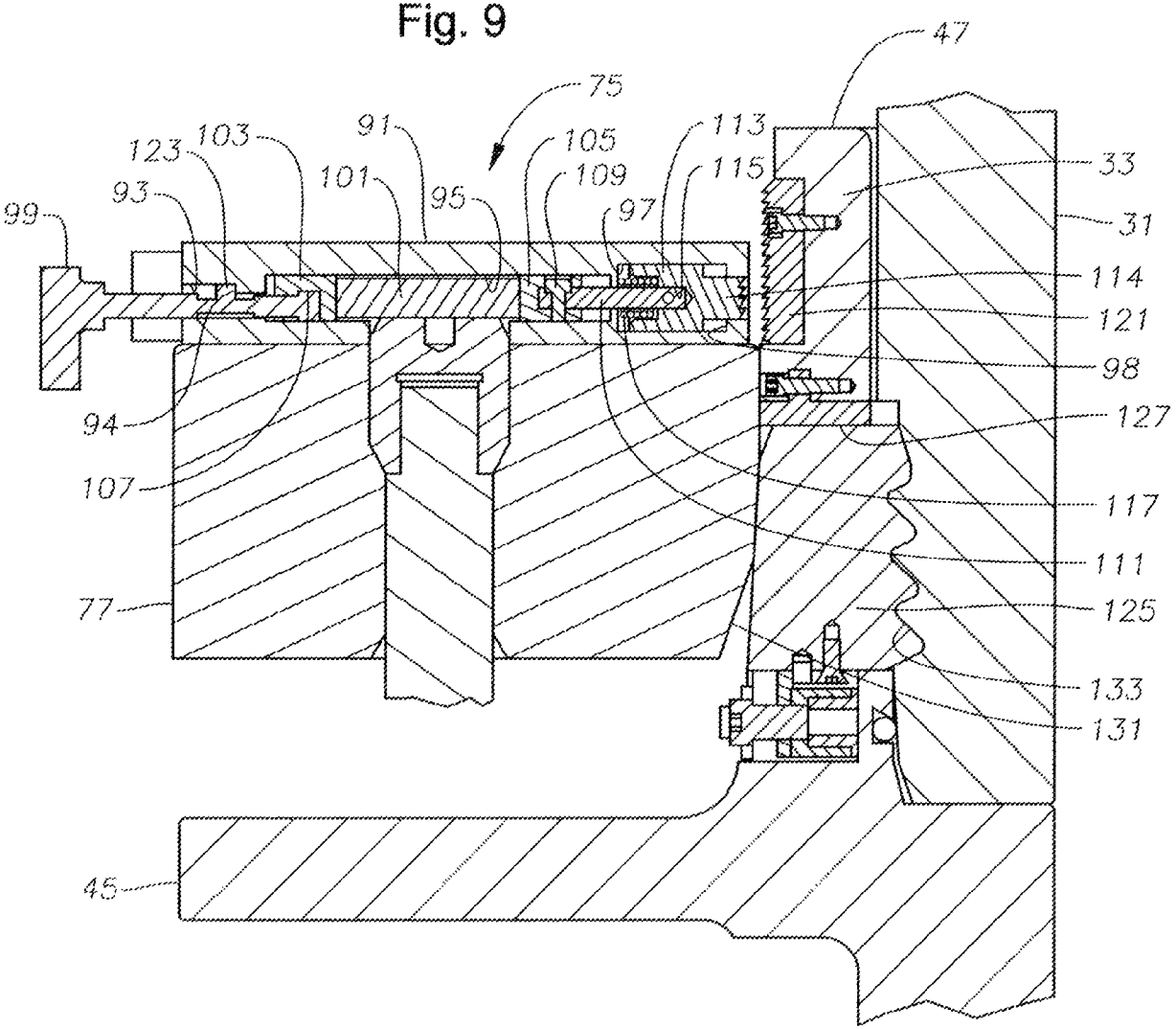
FIG. 9 is a partial sectional view of the drilling riser adapter taken along line 7-7 of FIG. 3.

In an operative example of the disengagement of drilling riser adapter 11, drilling riser adapter will be coupled inline in a marine riser as illustrated in FIG. 1 and be located at the sea floor. The components of drilling riser adapter 11 will be in the positions illustrated in FIG. 2, FIG. 4, FIG. 6, and FIG. 7. As described herein, operation of drilling riser adapter 11 will be described utilizing crossover joint 31 with profile 133. A person skilled in the art will understand that drilling riser adapter 11 may secure directly to a riser joint having a suitable profile without need of crossover joint 31. An ROV will first grip each latch 99 in turn and pull it radially away from tubular member 33. This will release each latch dog 113 from engagement with secondary engaging member 121. After pulling each latch 99 radially, and before moving to the next latch 99, the ROV will rotate latch 99 ninety degrees, thereby engaging key 123 with shoulder 94 of base member 91 as illustrated in FIG. 8 and FIG. 9.

After disengaging each latch 99, the ROV may stab a hot stab into hot stab port 135. Valves 143, 145 will be closed, preventing hydraulic fluid flow through either engaging circuit 151 or disengaging circuit 153. The ROV may then manipulate switch 139 to open valve 145 and allow hydraulic fluid to pump through the ROV, the hot stab port 135, valve 145 and into disengaging circuit 153. Hydraulic fluid will then flow through disengaging circuit 153 and into ports 149 below piston head 70. As fluid pressure builds up below piston head 70, the resulting pressure will force piston head 70 and rod 71 up, thereby raising cylinder coupler protrusions 77 and cam ring 73. When rods 71 reach their highest stroke, as shown in FIG. 10, the ROV will manipulate switch 139 to close valve 145 and stop flow through disengaging circuit 153. The internal pressure in disengaging circuit 153 will maintain cam ring 73 and cam ring assembly 57 in the disengaged position. Operators at platform 19 will then overpull the riser through manipulation of the operating equipment at platform 19. This will cause profile 133 to slide upward past engaging member 125, forcing engaging member 125 to move radially outward and allowing removal of crossover joint 31.

Similarly, in an operative example of the engagement of drilling riser adapter 11, drilling riser adapter 11 will be coupled to a subsea well head assembly 13 as illustrated in FIG. 1 and be located at the sea floor. In the exemplary embodiment, riser 17 has been damaged and removed from drilling riser adapter 11 as described above and a new riser 17 is to be coupled to drilling riser adapter in its place. The components of drilling riser adapter 11 will be in the positions illustrated in FIG. 5 and FIG. 8. In the exemplary embodiment, crossover joint 31 couples to the end of riser 17. An ROV will guide crossover joint 31 at the end of riser 17 into bore 37 of tubular member 33 until it occupies the position shown in FIG. 10.

The ROV may then stab a hot stab into hot stab port 135. Valves 143, 145 will be closed, preventing hydraulic fluid flow from passing through either engaging circuit 151 or disengaging circuit 153. The ROV may then manipulate switch 137 to open valve 143 and allow hydraulic fluid to pump through the ROV, hot stab port 135, valve 143 and into engaging circuit 151. Hydraulic fluid will then flow through engaging circuit 151 and into ports 147 above piston head 70 (FIG. 5). As fluid pressure builds up above piston head 70, the resulting pressure will force piston head 70 and rod 71 down (FIG. 4), thereby lowering cylinder coupler protrusions 77 and cam ring 73 (FIG. 9). When rods 71 reach their lowest stroke, as shown in FIG. 4, the ROV will manipulate switch 137 to close valve 143 and stop flow through engaging circuit 151. The internal pressure in engaging circuit 151 will maintain cam ring 73 and cam ring assembly 57 in the engaged position of FIG. 9, securing crossover joint 31 to drilling riser adapter 11.

Next, the ROV will operate secondary engaging assemblies 75 to provide a backup engaging mechanism. The ROV may first grip each latch 99 in turn and rotate each latch 99 ninety degrees, thereby releasing key 123 from shoulder 94 of base member 91. The ROV may then release latch 99, allowing spring 117 to move latch dog 113 radially into engagement with engaging member 121 as shown in FIG. 6 and FIG. 7. Optionally, the ROV may assist spring 117 by moving latch 99 radially toward tubular member 33 bringing latch dog 113 into engagement with secondary engaging member 121.

In a similar manner, drilling riser adapter 11 may secure to crossover joint 31 while drilling riser adapter 11 and crossover joint 31 are at platform 19 prior to running of the wellhead assembly to it subsea location. The components of drilling riser adapter 11 will be in the positions illustrated in FIG. 5, FIG. 8, and FIG. 10. An operator will guide crossover joint 31 into bore 37 of tubular member 33 with suitable platform tools until crossover joint 31 occupies the position shown in FIG. 10.

The operator may then secure a hydraulic line to hot stab port 135. Valves 143, 145 will be closed, preventing hydraulic fluid flow from passing through either engaging circuit 151 or disengaging circuit 153. The operator may then manipulate switch 137 to open valve 143 and allow hydraulic fluid to pump through the hydraulic line, hot stab port 135, valve 143 and into engaging circuit 151. Hydraulic fluid will then flow through engaging circuit 151 and into ports 147 above piston head 70 (FIG. 5). As fluid pressure builds up above piston head 70, the resulting pressure will force piston head 70 and rod 71 down (FIG. 4), thereby lowering cylinder coupler protrusions 77 and cam ring 73 (FIG. 9). When rods 71 reach their lowest stroke, as shown in FIG. 4, the operator will manipulate switch 137 to close valve 143 and stop flow through engaging circuit 151. The internal pressure in engaging circuit 151 will maintain cam ring 73 and cam ring assembly 57 in the engaged position of FIG. 7, securing crossover joint 31 to drilling riser adapter 11.

Next, the operator will manually operate secondary engaging assemblies 75 to provide a backup engaging mechanism. The operator may first grip each latch 99 and rotate latch 99 ninety degrees, thereby releasing key 123 from shoulder 94 of base member 91. The operator may then release latch 99 allowing spring 117 to move latch dog 113 radially into engagement with secondary engaging member 121 as shown in FIG. 6 and FIG. 7. Optionally, the operator may assist spring 117 by moving latch 99 radially toward tubular member 33 bringing latch dog 113 into engagement with secondary engaging member 121.

Accordingly, the disclosed embodiments provide numerous advantages over prior art riser adapters. For example, the drilling riser adapter disclosed herein provides a way to break out the connection between the LMRP/BOP and the riser once the LMRP/BOP assembly is at the subsea floor. Thus, where emergency events necessitate the ability to quickly disconnect an existing riser from the riser adapter and then reconnect a new riser or other device, the disclosed drilling riser adapter provides a means to do so.

In addition, the disclosed embodiments provide a drilling riser adapter that may be used with any type of riser joint with the addition of a suitable crossover joint that is easier and faster to secure to the riser. The drilling riser adapter accomplishes this with less man power needed, while also providing a backup system to ensure that the riser does not disconnect from the BOP until an operator specifically desires the release of the riser from the LMRP/BOP.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A system for connecting a lower marine riser package to a marine riser, the lower marine riser package (LMRP) to be placed subsea at a wellhead so that the riser will extend from the LMRP to a drilling rig located at a sea surface, the system comprising:

a drilling riser adapter for mounting to the lower marine riser package and having a hydraulically actuated engagement assembly for selectively engaging and disengaging a lower end of the marine riser;

a crossover riser joint having a lower end profile selectively mated with the engagement assembly when the engagement assembly is in an engaged state, and an upper end connection assembly selectively connected to the riser;

a control panel mounted to the adapter and communicatively coupled to the engagement assembly for actuating the engagement assembly to engage and disengage the lower end of the marine riser; and a receptacle for receiving hydraulic fluid pressure on the control panel for engagement by a remote operated vehicle (ROV) to supply hydraulic fluid pressure to the engagement assembly.

2. The system of claim 1, wherein the drilling riser adapter comprises:

a tubular member defining a central bore having an axis;

the central bore having an inner diameter larger than an outer diameter of the lower end of the riser such that the lower end of the riser may insert into the central bore;

a plurality of openings in an upper end of the tubular member proximate to a rim of the tubular member;

the openings extending from an exterior diameter surface of the tubular member to the central bore;

a plurality of engaging members, each engaging member substantially filling a respective opening;

the engaging members moveable between an engaged position radially inward and a disengaged position radially outward; and the engagement assembly configured to actuate the engaging members between the engaged and the disengaged position.

3. The system of claim 2, wherein each of the engaging members has a profile for engaging a matching profile on an exterior surface of the lower end of the riser.

4. The system of claim 2, wherein the engagement assembly comprises:

an axially moveable cam ring circumscribing the upper end of the tubular member proximate to the engaging members, the cam ring having an inner surface that slidingly engages outer surfaces of the engaging member; and a plurality of hydraulic cylinders to move the cam ring axially over the surface of the tubular member.

5. The system of claim 4, wherein the engagement assembly further comprises:

a plurality of cylinder coupler protrusions extending radially from an exterior diameter portion of the cam ring;

a flange formed in a portion of the tubular member axially below the cam ring; and each cylinder having a first end mounted to the flange and a second end coupled to a respective cylinder coupler protrusion for exerting an axial force on the cam ring.

6. The system of claim 4, wherein the engagement assembly further comprises:

a latch dog coupled to the cam ring, the latch dog biased radially inward to an engaged state;

a lever coupled to the latch dog for moving the latch dog between the engaged state and a disengaged state; and an inner end of the latch dog configured to engage a grooved exterior surface of the tubular member in the engaged state.

7. The system of claim 6, further comprising a key formed in a surface of the latch and configured lock the latch dog in a disengaged state when pulled radially and rotated by the ROV.

8. The system of claim 1, further comprising:

a latch that selectively locks the engagement assembly in an engaged position; and a handle on the latch configured to be engaged and manipulated by the ROV.

9. The system of claim 1, further comprising a pair of valves on the control panel to direct the hydraulic fluid pressure to engage and release the engagement assembly from the lower end of the marine riser, the valves being configured to be engaged by the ROV.

10. A system for connecting a lower marine riser package to a marine riser, the lower marine riser package (LMRP) to be placed subsea at a wellhead so that the riser will extend from the LMRP to a drilling rig located at a sea surface, the system comprising:

a blowout preventer (BOP) mounted at an upper end of the LMRP;

a drilling riser adapter for mounting to the BOP and having a hydraulically actuated engagement assembly for selectively engaging and disengaging a lower end of the marine riser;

a crossover riser joint having an end selectively mated with the engagement assembly when the engagement assembly is in an engaged state, and an upper end connection assembly selectively connected to the marine riser;

a control panel mounted to the adapter and communicatively coupled to the engagement assembly for actuating the engagement assembly to engage and disengage the lower end of the marine riser; and a receptacle for receiving hydraulic fluid pressure on the control panel for engagement by a remote operated vehicle (ROV) to supply hydraulic fluid pressure to the engagement assembly.

* * * * *